United States Patent [19]

Stewart

[11] 4,150,904

[45] Apr. 24, 1979

[54] ROLLER APPLICATOR WITH PRESSURE RESPONSIVE VALVE

[76] Inventor: Paul Stewart, 8272 Marmont La., Los Angeles, Calif. 90069

[21] Appl. No.: 816,701

[22] Filed: Jul. 18, 1977

[51] Int. Cl.[2] ..... B05C 17/02; B43M 11/02

[52] U.S. Cl. ..... 401/186; 401/205; 401/219

[58] Field of Search ..... 401/183, 186, 197, 206, 401/207, 208, 219, 202, 146; 16/115; 15/143 B, 144 R, 144 B, 145; 222/490, 491, 492, 494

[56] References Cited

U.S. PATENT DOCUMENTS

| | | | |
|---|---|---|---|
| 2,229,707 | 1/1941 | Testi | 401/219 |
| 2,279,320 | 4/1942 | Huston | 401/186 |
| 2,347,596 | 4/1944 | Swart | 16/115 X |
| 2,667,867 | 2/1954 | Peterson | 401/208 X |
| 3,027,591 | 4/1962 | Peterson | 401/183 |
| 3,076,995 | 2/1963 | Rabelow | 401/206 X |
| 3,103,682 | 9/1963 | Markle | 15/144 B X |
| 3,372,976 | 3/1968 | MacFarland | 401/202 X |
| 4,072,429 | 2/1978 | Terzian et al. | 401/208 X |

*Primary Examiner*—Ronald E. Suter

*Attorney, Agent, or Firm*—Poms, Smith, Lande, Glenny & Rose

[57] ABSTRACT

A fluid applicator has a fluid absorbant dispensing roller mounted by an applicator head having inlet means for releasably connecting the roller in fluid communication with a disposable fluid storage container and fluid pressure responsive valve means in the applicator head for restricting fluid flow to the roller normally whereby the roller is applied with fluid by manually squeezing the container.

2 Claims, 5 Drawing Figures

ROLLER APPLICATOR WITH PRESSURE RESPONSIVE VALVE

BACKGROUND OF THE INVENTION

The present invention relates in general to hand held and manipulated fluid applicators having a self-contained supply of fluid dispensed by an associated roller. More specifically, the present invention relates to fluid applicators having a fluid absorbant dispensing roller and a squeezable, disposeable fluid storage container connected by a roller-mounting applicator head for metering fluid from the container to the roller in use.

Various types of roller applicators have been divised heretofore, such as in U.S. Pat. No. 3,076,995. This prior patent discloses an applicator having a body portion to which a container for liquids is removably attachable. The body has a manifold-like tube having a plurality of discharge orifices for distributing the fluid to a strip of felt or other porous resilient material, the latter transmitting the liquid to an associated resilient roller. This type of applicator is intended for use with ink or the like which can pass through a porous member. It is believed that this type of applicator is not well suited for applying more viscous material such as sun tan lotion or the thicker, modern latex based paints.

Another example of prior applicator devices is that of U.S. Pat. No. 3,027,591 which discloses a somewhat similar type of applicator, but wherein a single nozzle is used for applying a more viscous liquid to the roller. The liquid is applied directly to the roller without, it is believed, an entirely satisfactory metering means for applying sun tan lotions or paints as is contemplated within the present invention.

SUMMARY OF THE INVENTION

It is a primary object of the present invention to disclose and provide a fluid applicator having a fluid absorbant dispensing roller and a squeezable, disposable fluid storage container wherein the interconnecting applicator head is constructed in a novel and more facile manner to provide a more easily controlable distribution and rate of dispensing of liquids such as sun tan lotions, and the like, onto the roller for application by the roller to the human body.

It is another object of the present invention to disclose and provide a fluid applicator as in the foregoing object wherein the applicator may be employed for dispensing paints and other materials of the viscosity of commonly-used sun tan lotions presently available, and more specifically, wherein fluid passage means are provided in an improved manner in association with valve means to allow for the dispensing of fluids through manual squeezing of the associated container in a manner such that the roller is supplied with fluid when desired, and not inadvertently as might occur when the applicator is positioned upside down or in other positions wherein the force of gravity on the stored fluid may cause it to tend to run to the roller.

Generally stated, the present invention comprises the provision in a fluid applicator having a fluid absorbant dispensing roller and a squeezable, disposable fluid storage container assembly the provision of an applicator head having means for rotably mounting the dispensing roller, inlet means on the head for releasably connecting the container to the head, fluid passage means in the applicator head for communicating fluid from the inlet means to the roller and fluid pressure responsive valve means in the fluid passage means for restricting fluid flow to the roller whereby the roller is supplied with fluid by pressurizing of the stored fluid above that normally applied by gravity, as by manually squeezing the container.

More specifically, the present invention contemplates an applicator head having a pair integrally formed spaced mounting arms extending outwardly of the head and providing opposed journal ports to removably receive axel ends of a roller member by manually spreading of the mounting arms within their elastic limit. Further, the present invention contemplates the provision of a plurality of fluid dispensing ports in a generally linear array between the arms adjacent to where the roller is mounted with internal manifold means supplying each of the ports with a dispensing fluid at a generally equal pressure. As is particularly contemplated within the present invention, the dispensing ports are provided symmetrically of a center line through the applicator head with the spacing of the ports increasing as the ports are located outwardly of the head center line. Valve means, in accordance with the present invention, are provided to supply the dispensing fluid to the manifold means in response to pressurizing of the container, as by manual squeezing thereof. Specifically, such valve means comprise a sheet of nylon molded into conical form with a pinhole at the apex thereof and the cone located in the applicator head with its open base facing the incoming fluid and its apex, with the associated pinhole, facing toward the manifold means and lying within the fluid passage thereto.

A more complete understanding of the present invention in fluid applicator, as well as a better understanding of additional objects and advantages thereof, will be afforded to those skilled in the art from a consideration of the following detailed explanation of the preferred exemplary embodiment thereof. Reference will be made hereinafter to the appended sheets of drawings which will be first briefly described.

DETAILED DESCRIPTION OF A PREFERRED EXEMPLARY EMBODIMENT

Figure 1:
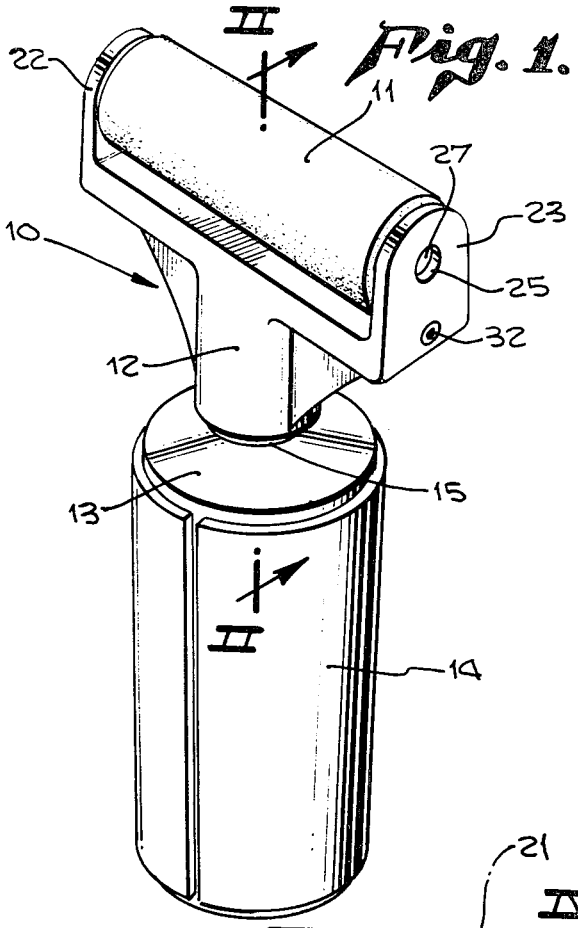
FIG. 1 is a perspective view of a preferred exemplary embodiment of fluid applicator according to the present invention.
Figure 2:
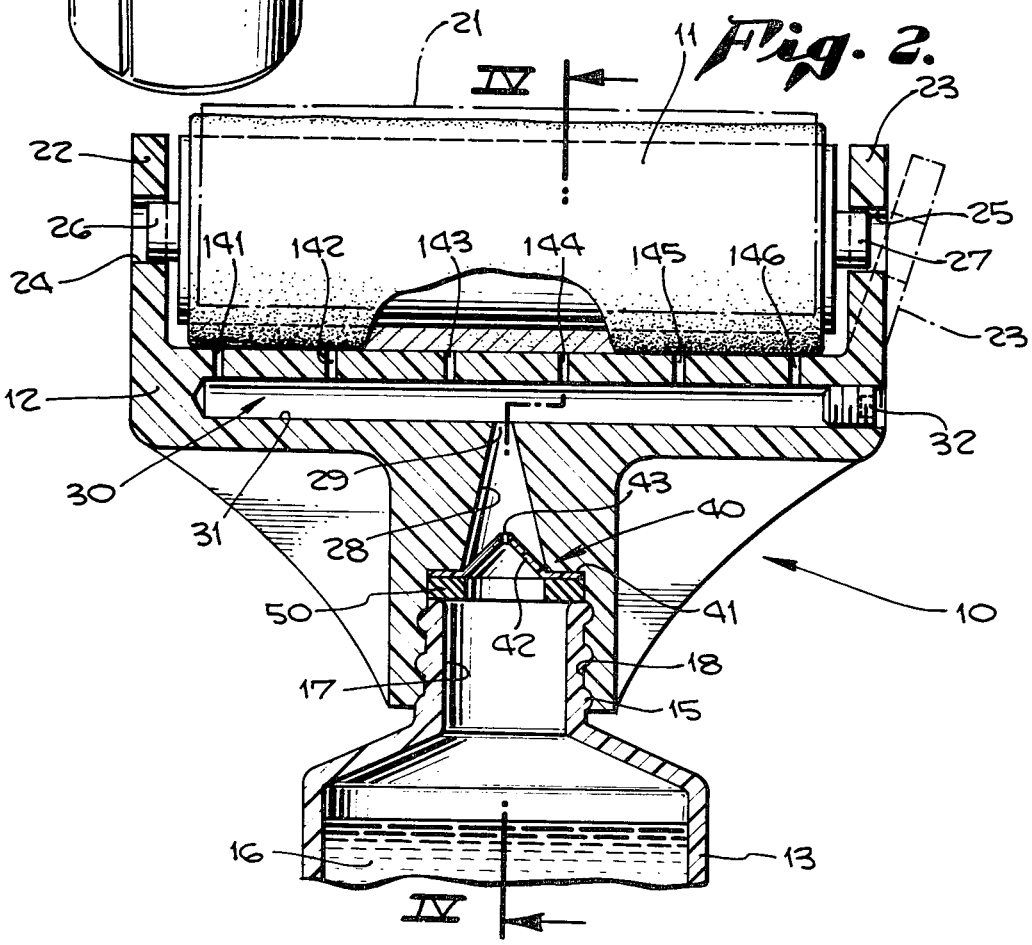
FIG. 2 is a section view of the applicator of FIG. 1 taken therein along the plane II—II.

Referring initially to FIG. 1, a preferred exemplary embodiment of fluid applicator, in accordance with the present invention, is indicated generally at 10, and includes a fluid absorbant dispensing roller 11 mounted to an applicator head 12 which is removably secured to a disposable fluid storage container 13. As discussed more fully hereinafter, an extensible handle cylinder 14 is snugly slip fit about container 13 to function as an extendible handle for use of the applicator. Roller 11, as it is known in the art, may be made of a synthetic or cotten material, i.e. a latex paint roller, suitable for absorbing materials, such as sun tan lotion, paint or the like and dispensing them upon surfaces against which roller 11 is rolled. Similarly, disposable container 13 may be made in known manner of a pliant injection molded plastic material having an upper threaded end 15, as seen in FIG. 2, such that fluid 16, such as sun tan lotion, paint or the like, may be dispensed through container outlet 17 by simply manually squeezing and thus compressing the side walls of container 13.

Figure 4:
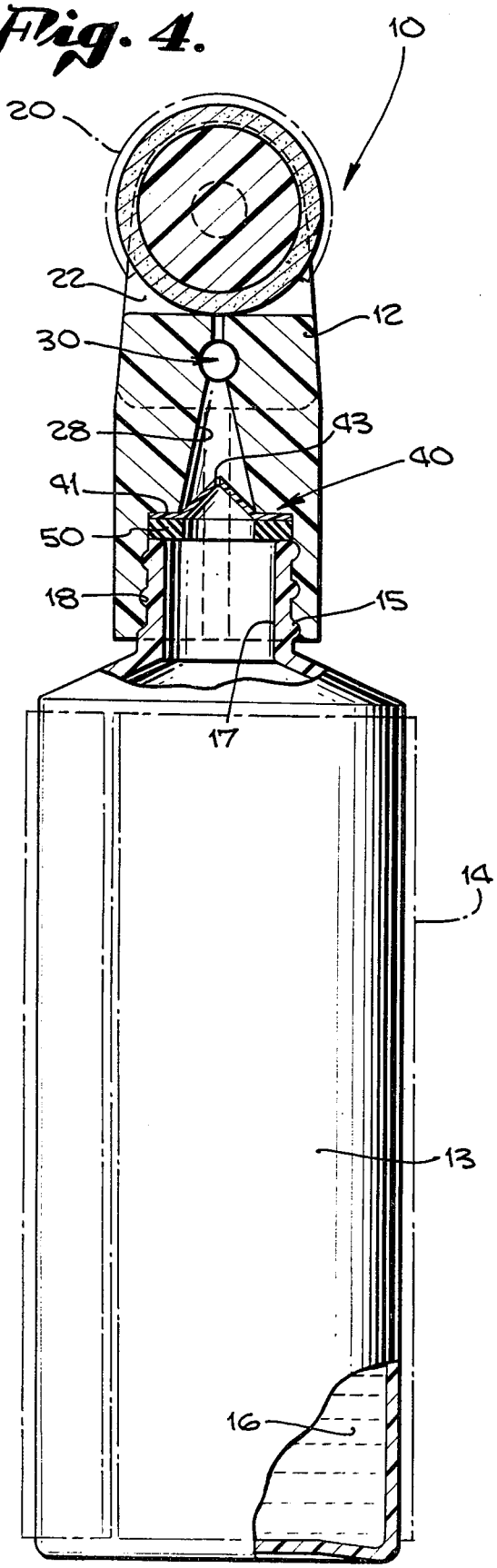
FIG. 4 is a section view of the applicator of FIG. 2 taken therein along the plane IV—IV.
Figure 5:
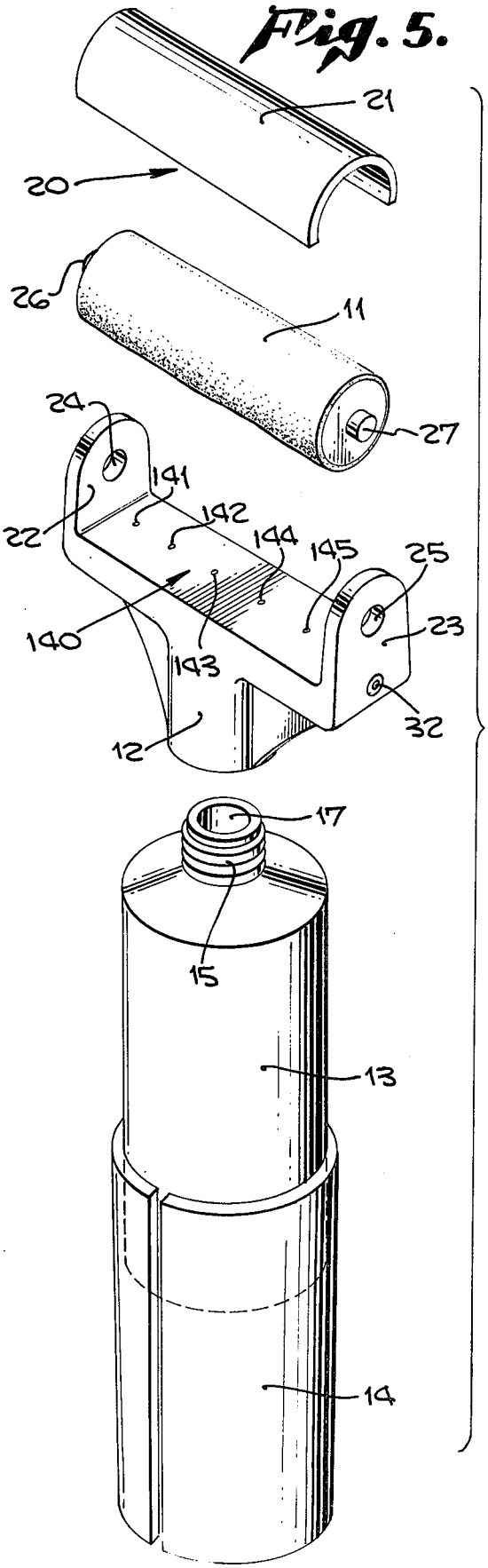
FIG. 5 is an exploded, perspective view of the components of the applicator of FIGS. 1 through 4.

Roller cover means, indicated generally at 20, are to normally cover roller 11 which may be damp from the dispensible fluid 16 between times of use. As seen in FIGS. 2, 4 and 5, such roller cover means, in the exemplary embodiment, comprise a cover member 21 of cylindrical configuration, but portions of the cylinder being cut away to leave a cylinder portion as seen in FIG. 5 suitable to be snapped over the roller, as seen in FIG. 4. Cover 21 may be made of a resilient plastic material such that it may be manually snapped on and off of the roller 11.

As is contemplated within the present invention, an applicator head is provided to mount roller 11 and transmit fluid 16 from container 13 thereto. In the exemplary embodiment, such applicator head is indicated at 12, and as is seen in FIG. 2, has inlet means, including internally threaded bore 18, to removeably receive the outlet end of container 13.

Means for rotably mounting roller 11 on applicator head 12, in the exemplary embodiment, comprise a pair of spaced mounting arms 22 and 23 which are formed integrally of head 12. Journal ports 24 and 25 are formed in each of the arms 22 and 23, respectively, to receive respective axle ends 26 and 27, as best seen in FIG. 2. In accordance with the present invention, and as indicated in dotted line in FIG. 2, the integrally formed arms 22 and 23 are sufficiently resilient to allow resilient deformation thereof to allow assembly and disassembly of roller 11 thereto without the need for additional fastener devices.

Fluid passage means are provided within applicator head 12 for communicating fluid 16 from container 13 to roller 11 in a manner in accordance with the present invention. As best seen in FIGS. 2 and 4, inlet bore 18 communicates through valve means, indicated generally at 40 and described subsequently herein, through a convergent passage 28 into a manifold means, indicated generally at 30 via port 29.

Manifold means, indicated generally at 30, are formed in the exemplary embodiment applicator head 12 by drilling a bore 31, as seen in FIG. 2, through the head to intersect passage 28 at port 29 and is thereafter, tapped and then plugged by set screw or plug 32. As seen in FIG. 2, it is considered desireable to have the manifold means, indicated generally at 30, extend substantially over the entire length of the applicator head between arms 22 and 23 in order to dispense fluid to the dispensing roller 11 as hereinafter described.

As is particularly contemplated within the present invention, a plurality of dispensing ports are provided in the exemplary embodiment of applicator head 12 in a predetermined spacing, location and size to render the applicator particularly well suited for dispensing viscous fluids such as sun tan lotions upon roller 11. Such ports, indicated generally at 40 in FIGS. 2 and 5, in the exemplary embodiment, comprise six individual dispensing ports 141–146. Preferably, the diameter of these ports, for dispensing conventional sun tan lotions, are provided with a diameter on the order of 0.035 to 0.038 inches. In addition, I found it particularly preferable to locate ports 143 and 144 approximately $\frac{1}{4}$ inch outwardly of a center line through the applicator head between the ports, ports 142 and 145 spaced approximately $\frac{3}{4}$ of an inch from said center line and ports 141 and 146 spaced $1\frac{1}{4}$ inches each from said center line. The left-hand and right-hand three port arrays are thus progressively spaced further from the center line on the order of $\frac{1}{4}$, $\frac{3}{4}$ and $1\frac{1}{4}$ inches. This distribution of sun tan lotion onto roller 11 is the greater in the center areas of the longitudinal extent of roller 11 and is more easily manageable in manipulating the roller as herein described.

Figure 3:
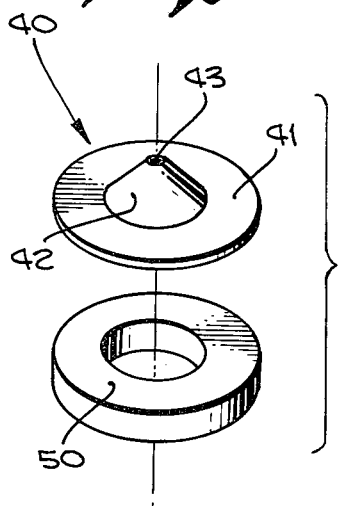
FIG. 3 is an exploded view of valve means employed in the applicator of FIGS. 1 and 2.

As is further specifically contemplated within the present invention, fluid pressure responsive valve means are provided in the present invention in fluid applicator, an exemplary embodiment of such valve means being indicated generally at 40. As best seen in FIGS. 2, 3 and 4, the exemplary valve means, indicated generally at 40, comprises a circular sheet 41 of plastic material with a conical central portion 42 molded therein. A pinhole 43 is provided at the apex of conical portion 42. A sealing ring 50 is provided in association with the valve member 41 which may be used to seat and seal valve 41 head 12 as seen in FIG. 2. Member 41 is preferably made of a plastic material, such as a nylon sheet. Conical portion 42 may be formed by thermosetting or molding of the sheet material with a small pinhole 43 thereafter being provided at the apex of the cone. A pinhole is selected of a size to normally prevent the passage of the contained fluid 16, such as a sun tan lotion, therethrough due to the force of gravity. However, on squeezing of the squeezable container 13, the fluid 16, such as sun tan lotion, can be exuded through pinhole 43 under a few pounds per square inch fluid pressure to cause the fluid to fill manifold 30 and exude through ports 141–146 onto roller 11 when desired. As seen in FIG. 2, valve member 41 is located at the inner end of inlet bore 18 against a stopshoulder formed by the smaller convergent passageway 28 with the cone base facing the container inlet 17 and the cone apex facing downstream of passage 28 toward roller 11.

As briefly mentioned hereinbefore, an extendible handle member 14 is provided about container 13 in the preferred exemplary embodiment. Handle member 14, in the exemplary embodiment, comprises a split cylinder of resilient plastic material, such as high impact plastic, and is sized to be slip fitted snugly about container 13 to normally ride therewith in a friction fit, i.e. requires manual movement of cylinder 14 to cause relative motion between cylinder 14 and cylinder 13.

As can be seen from the foregoing, the fluid applicator of the present invention may be used to apply sun tan lotion or other body lotions by removing the cap from a bottle of lotion, such as container 13, and screwing such bottle onto the exemplary applicator head 12 through the provision of a mating internally threaded inlet 18. The plastic roller cover 21 is then removed, extendible handle member 14 is slid downwardly as seen in FIG. 5, or perhaps removed if convenient, and container 13 is squeezed to start the flow of material 16 into the roller head 12. As the fluid passes through the manifold 30, it is thereby distributed at a substantially equal pressure to the non-uniformly spaced dispensing ports 141–146 to roller 11. The user preferably rotates the roller once or twice to cause the fluid 16 to be absorbed into roller 11. The roller is then applied to body surfaces upon which the material to be dispensed is to be applied with the applicator being rolled back and forth, preferably in short strokes of 2 to 6 inches at a time when applying a sun tan lotion material to the human body. When applying lotion to oneself, extendible handle member 14 is available for reaching areas of the back which might be difficult to otherwise reach. On completion of a fluid application procedure, roller 11 may be capped by cover 21 to prevent inadvertent application of the dispensing fluid. Further, on depletion of the fluid from container 16 or if a cleanup operation is otherwise desirable, it can be seen from the foregoing that the present applicator can be simply disassembled by unscrewing container 13 from the applicator head 12 and snapping roller 11 out from between resilient, bendable arms 22 and 23. Container 13 may be sealed by a mating cap or disposed of it is a disposable bottle product utilized with the present embodiment of applicator head 12. Applicator head 12 may be easily cleaned, as can the removed roller 11, the latter being easily replaced if preferred.

Having thus described an exemplary embodiment fluid applicator having a fluid absorbant dispensing roller and an applicator head for removably mounting the roller to a disposeable fluid storage container in fluid communication, it should be understood by those skilled in the art that various modifications and adaptations thereof may be made within the scope and spirit of the present invention which is defined by the following claims.

I claim:

1. A fluid applicator having a fluid absorbant dispensing roller and a squeezable, disposable fluid storage container comprising:

an applicator head having means for rotably mounting said roller;

inlet means on said head for releasably connecting said container to said head;

fluid passage means in said applicator head for communicating fluid from said inlet means to said roller;

fluid pressure responsive valve means in said fluid passage means for restricting fluid flow to said roller whereby said roller may be supplied with fluid by manually squeezing said container, wherein said valve means comprises: a hollow cone of flexible plastic material having a pin hole at the apex thereof, said cone opening toward said container with the apex end pointing downstream of said fluid passage means, said pin hole being of a predetermined size to permit fluid flow therethrough normally only in response to pressurizing of fluid upstream of said cone as by said squeezing of said container; and an extensible handle means on said container wherein said handle means comprises: a split cylinder of resilient material slip fitted snugly about said container and manually slidable relative thereto.

2. A fluid applicator having a fluid absorbant dispensing roller and a disposable, squeezable fluid storage container comprising:

an applicator head having a plurality of fluid dispensing ports in a generally linear array and roller mounting means for mounting said roller adjacent and aligned to said ports;

manifold means within said head in fluid communication with each of said ports;

fluid inlet means in said head releasably connectable with said container for receiving fluid from said container into said head;

fluid pressure responsive valve means in said head adjacent said inlet means for normally preventing fluid flow therethrough but allowing same under fluid pressure developed by manually squeezing said container;

fluid passage means in said head for communicating fluid from said valve means to said manifold means, wherein said roller mounting means comprise a pair of resiliently bendable spaced arms formed integrally of said head whereby said roller may be assembled or disassembled through manual spreading of said arms; and wherein said fluid dispensing ports are positioned symetrically about a center line through said applicator head and are spaced from each other in increasingly greater spacings between successive ports as the ports progress outwardly of said center line.

* * * * *